United States Patent [19]

Reil et al.

[11] 4,287,247

[45] Sep. 1, 1981

[54] PACKING LAMINATE PROVIDED WITH CREASE LINES

[75] Inventors: Wilhelm Reil, Bensheim-Auerbach; Jörg Trabitzsch, Seeheim-Jugenheim, both of Fed. Rep. of Germany

[73] Assignee: Tetra Pak International AB, Lund, Sweden

[21] Appl. No.: 72,314

[22] Filed: Sep. 4, 1979

[30] Foreign Application Priority Data

Sep. 4, 1978 [SE] Sweden ..... 7809268

[51] Int. Cl.[3] ..... B32B 3/04; B29C 17/00; B29D 3/10

[52] U.S. Cl. ..... 428/129; 220/450; 229/48 T; 156/198; 156/218; 156/226; 156/227; 428/130; 428/167

[58] Field of Search ..... 428/167, 129, 130; 220/450; 229/3.5 MF, 48 R, 48 T; 156/69, 198, 217, 218, 226, 227

[56] References Cited

U.S. PATENT DOCUMENTS

| | | | |
|---|---|---|---|
| 3,240,845 | 3/1966 | Voelker | 428/425 |
| 3,506,516 | 4/1970 | Bauman | 156/226 |
| 3,526,566 | 9/1970 | McIlvain, Jr. et al. | 428/130 |

*Primary Examiner*—William R. Dixon, Jr.
*Attorney, Agent, or Firm*—Burns, Doane, Swecker & Mathis

[57] ABSTRACT

A packing laminate of the type comprising at least two layers of material and at least two converging or intersecting crease lines which assist the conversion of the laminate to a packing container is disclosed. The laminate is provided with at least one auxiliary crease line where the crease lines converge or intersect in order to prevent crack formation in the layers of the laminate and consequent leakage in the container formed therefrom. A method is also disclosed for manufacturing a laminate in which the laminate is provided with auxiliary crease lines after the converging or intersecting crease lines have been provided.

16 Claims, 5 Drawing Figures

PACKING LAMINATE PROVIDED WITH CREASE LINES

The present invention relates to a packing laminate provided with crease lines for conversion to packing containers.

The invention also relates to a method for the manufacture of a packing laminate.

Packing containers of the non-returnable type are often manufactured of material in the form of webs or sheets provided with crease lines. The material is then converted by folding and sealing to a packing container of the desired shape. To this end a laminated material is used, among others, which contains different material layers which impart to the combined laminate the desired properties when stiffness, strength and impermeability to liquids are required. A packing laminate, used frequently, comprises a centrally positioned relatively thick carrier layer of fibrous material which layer is covered on both sides with homogeneous plastic layers. The plastic layers are constituted of thermoplastic material which makes possible a simple sealing of the material by heating and compression of the plastic layers on the two parts of material which are to be joined together.

To reduce the light transmittance of the packing laminate, the laminate frequently contains further layers, e.g. a layer of aluminium foil placed between the carrier layer and one of the thermoplastic layers, which in the finished packing container very effectively protects the packed goods from the effect of light.

In the forming of the packing containers the laminated material is subjected to considerable stresses. This applies particularly to the folding of the material, since a folding of the material, owing to the relatively great stiffness of the carrier layers, means that one of the thermoplastic layers is subjected to an appreciable stretching, while the opposite thermoplastic layer is pressed together along the whole folding line. However, owing to the great extensibility of the thermoplastic material, this does not often cause the thermoplastics to suffer damage or to lose their impermeability to liquids. The situation becomes worse, however, if the packing laminate also comprises layers of aluminium foil, which compared with the thermoplastic layer possess only low extensibility and thus tend to crack when the laminate is folded.

Even though a simple folding of a packing laminate of the described type about 180° will not have any serious consequences insofar as the impermeability of the material to liquids or its light transparence are concerned, considerable difficulties arise when two such folding lines cross each other. This is often the case along the seal or seals which are always present on packing containers. Seals are usually made by heating the thermoplastic layers which are facing towards the inside of the packing container along the edge zones of the packing laminate which are to be joined together, whereupon the two areas of layer heated to softening are placed together and compressed so that a sealing fin is produced which is situated at the outside of the packing container and comprises two laminate layers. So as not to form an obstacle, the sealing fin is often folded down against the outside of the packing container, which means that the one laminate layer undergoes a 180° folding and that the packing container wall in the actual sealing area consists of three laminate layers, that is to say, it has threefold thickness.

A seal of the abovementioned type often runs along one or more of the side faces of the packing container and since these side faces, e.g. in the forming of parallelepipedic packages from cushion-shaped packages are subjected to a 180° folding along a folding line which forms a 90° angle with the seal (described in more detail in the following) the material thickness in certain limited areas of the packing container will amount to 6 times the laminate thickness. In such a 180° folding transversely to the sealing area the material layer which after the folding is situated on the outside of the fold (that is to say, the material layers situated outside the neutral plane produced) will be subjected to very strong tensile stresses with accompanying stretching and crack formations. These tensile stresses are so great that frequently not only any aluminium foil layers included in the laminate crack but also the thermoplastic layer with the result that leakages occur.

In order to overcome the aforementioned disadvantages it has been endeavoured up to now, among other things, to raise the elasticity of the materials included to the highest possible degree which gives a relatively good result insofar as the thermoplastic material is concerned, but does not solve the problem of any aluminium layer included in the laminate.

Another known solution proposes the punching out of parts of the carrier layer of the laminate in the critical folding zones so as to make it possible for the remaining plastic and aluminium layers to come near the neutral plane of the fold and more or less accurately follow the same around the fold. This solution gives some positive results but makes the manufacture of the material more complicated.

It is an object of the present invention to provide a packing laminate which renders possible the realization of the aforementioned folding without the risk of crack formation or leakage, and without the disadvantages affecting the methods proposed previously.

It is a further object of the present invention to provide a method making possible the folding of several layers of packing laminate comprising layers of aluminium foil or other material of low extensibility without risking crack formation along the folding line in the outer layers.

These and other objects have been achieved in accordance with the invention such that a packing laminate of the type described in the introduction provided with crease lines has been given the characteristic that in the area of the packing laminate where crease lines converge or cross each other at least one crease line is substituted by or is completed by an auxiliary crease line.

A preferred embodiment of the laminate in accordance with the invention has been given the further characteristic that an auxiliary crease line is arranged on each side of the said crease line or of the imaginary extension of the same.

A preferred embodiment of the laminate in accordance with the invention has been given the further characteristic that the auxiliary crease line is situated substantially adjoining the crease line and extends in the principal direction of the same.

A further preferred embodiment of the laminate in accordance with the invention has been given the further characteristic that the auxiliary crease lines are substantially parallel with the crease line.

A further preferred embodiment of the laminate in accordance with the invention has been given the further characteristic that the auxiliary crease line, in the case of two crease lines crossing each other, is arranged along the crease line which will be used last in the conversion of the laminate to a packing container.

A further object of the present invention consists in providing a method for the manufacture of a packing laminate of the type described above.

This object has been achieved in accordance with the invention by a method for the manufacture of a packing laminate which has been given the characteristic that the auxiliary crease lines are formed after the remaining crease lines.

A preferred embodiment of the arrangement in accordance with the invention will now be described in detail with reference to the figures on the enclosed schematic drawing.

FIG. 1 shows in perspective a part of a packing container wall with a sealing fin which has been folded to lie against the outside of the packing container laminate.

FIG. 1*a* shows in perspective the reverse side of the packing container wall of FIG. 1 with the crease lines which are utilized in folding the packing container wall (as shown in FIG. 2) being shown.

Figure 1:
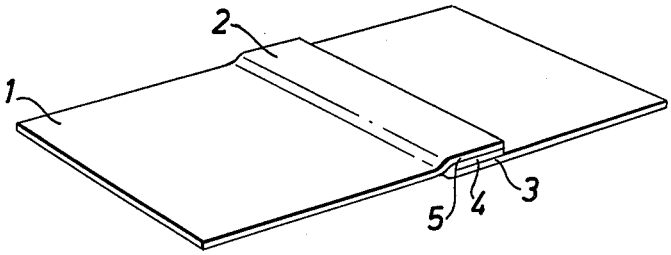

The packing laminate shown schematically in FIG. 1 is of a known type and comprises a relatively thick, central carrier layer of e.g. paper, which layer imparts the required stiffness to the material. In order to prevent the fibrous carrier layer from absorbing moisture from the environment and from the packed goods the carrier layer is provided on both sides with thin layers of a homogeneous plastic material which is preferably of the thermoplastic type. Depending on the type of contents which are to be kept in the packing container manufactured from the packing laminate the packing laminate may also comprise further layers for different purposes, e.g. an aluminium layer which is impervious to light so as to prevent the contents from being exposed to and affected by daylight. Further layers with special objectives are also conceivable. Since the type of laminate described is well-known to those versed in the art, the different layers have not been marked on the laminate shown in the figures, but for the sake of greater clarity the laminate has been drawn as if it consisted of a single layer.

In FIG. 1 is shown a portion of a packing container wall 1 with a seal of the inside facing material to inside facing material type. This seal is achieved in that along the edge zones which are to be joined the thermoplastic layers of the material facing towards the inside of the packing container are heated, whereupon the layers are pressed against one another so that a seal is produced with a sealing fin 2 situated on the outside of the package. So that it should not form an obstacle and attach itself to neighbouring packages or the like the sealing fin 2 is subsequently folded so as to lie against the outside of the packing container. In the area of the seal the packing container will therefore have three-fold wall thickness and comprise, more particularly, an inner material layer 3 which constitutes the actual packing container wall in the sealing area, and two material layers 4 and 5 forming the sealing fin 2. The material layer 4 constitutes a part of the material layer 3 folded about 180° and the material layer 5 constitutes a continuation of the opposite of the two wall portions sealed in the sealing fin.

The type of seal described above is customary and occurs in a great number of packing containers of the non-returnable type. In a known non-returnable package which is used e.g. for liquid dairy products and which is manufactured by conversion of a material web to a tube provided with a longitudinal joint, which is filled with contents and is sealed off by means of transverse seals situated at equal distances, this type of seal is used. These packages which after filling and sealing are given a practically cushion-like shape are subsequently converted with the help of forming jaws to substantially parallelepipedic shape, whereby among other things the cushion-corners are pressed flat and are folded in and sealed against the sides of the packing container. As a result the sides on which the sealing fins are situated will be folded about 180° along a crease line which is situated right-angled to the sealing fin.

Figure 2:
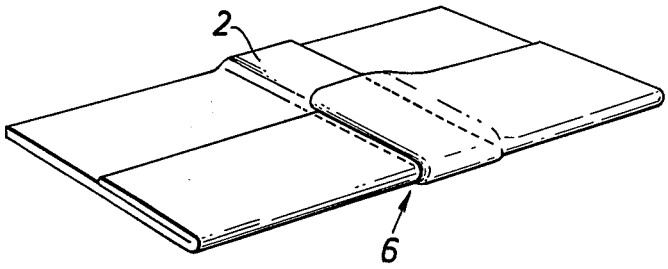
FIG. 2 shows in a perspective a portion of the packing container wall in accordance with FIG. 1 after folding about 180° along a folding line which extends right-angled to the longitudinal axis of the sealing fin.
Figure 3:
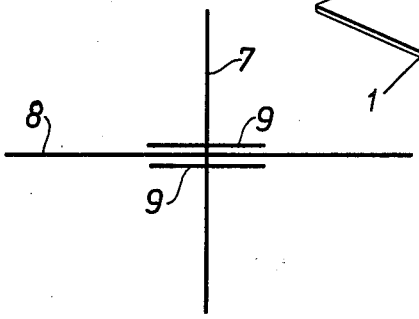
FIG. 3 shows schematically a crease line pattern in accordance with the invention in the case of two crease lines crossing at right angles.
Figure 1A:
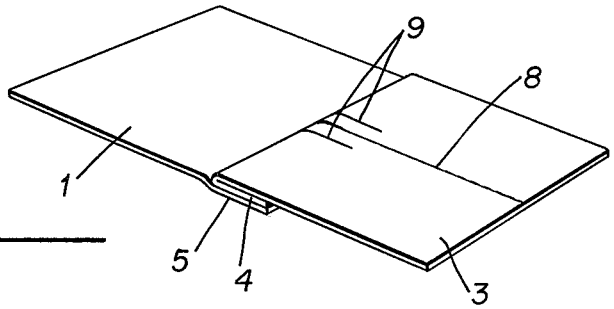

FIG. 1*a* is an obverse view of the packing laminate of FIG. 1 before the folding shown in FIG. 2 takes place. The crease line arrangement of FIG. 3 is utilized for the folding.

This is illustrated in FIG. 2 where, as in FIG. 1, the sealing fin is indicated by reference numeral 2 while the point at which the two 180° folds cross one another is indicated by reference numeral 6. In this point consequently a 180° folding takes place of the sealing fin 2 consisting of three laminate layers along a crease line extending parallel with the sealing fin, resulting in a sixfold material thickness. When the three-fold material is folded about 180° the neutral plane, that is to say, the plane wherein neither tensile nor compressive stresses occur, will come to lie substantially between the two material layers 4 and 5 forming part of the fold. In other words, the material layer 5 situated within the neutral plane will be pressed together and compressed at the point of folding while the two material layers 3 and 4 situated outside the neutral layer will be subjected to tensile stresses, which usually give rise to cracks in the carrier layer of the material layer 3 and often also to crack formation in the carrier layer situated inside the material layer 4. This crack formation is of little consequence. However, owing to the great tensile stresses in the material layer 3 situated outermost, cracks will often be formed also in the thermoplastic layers of this laminate layer, and that has an adverse effect on the impermeability of the packing container. When the packing container laminate is of the type which comprises layers of aluminium foil, the double folding of the laminate described invariably leads to crack formation in the aluminium layer, and this crack formation often progresses into the two outer material layers 3 and 4.

The folding of the packing laminate generally takes place along crease lines which guide the fold and ensure that the same finds its right place and obtains the right direction. The crease lines constitute linear weakenings of the material and usually consist of a linear compression or ridge which is created when the material is processed between two cylinders provided with corresponding ridges or ridges and recesses. Since the crease lines necessarily signify a weakening of the material any crack formations will also be concentrated in the material situated in or close to the crease lines and a particularly critical point will be the place on the packing laminate where two or more crease lines converge or cross one another.

The risk of crack formation is eliminated in accordance with the invention because at the places where crease lines converge or cross one another the packing laminate is given a new crease line pattern which reduces and disperses the stresses at the critical point 6. In the FIGS. 3 and 4 two embodiments of such a crease line pattern are shown wherein two crease lines 7 and 8 respectively intersect each other at right angles. As can be seen from these figures, one of the crease lines crossing each other is substituted or completed in the area of intersection by one or more auxiliary crease lines which extend in the principal direction of this crease line. The auxiliary crease lines are indicated in FIG. 3 by reference numeral 9 and in FIG. 4 by reference numeral 10. The auxiliary lines 9 and 10 respectively, as can be seen from the drawing, are preferably arranged on either side of the main crease line 8 or, as is the case in FIG. 4, on either side of an imaginary extension of the main crease line 8. The auxiliary crease lines are situated closely adjoining the main crease line or its extension, which means that the material in connection with the crease line will be softened up so that it can better withstand the stresses arising in the subsequent folding. The placing also has the effect that the material on creasing will be stretched in two or three lines adjoining one another, so that a material surplus arises which is then made use of for diminishing the stresses in the fold. Finally, the parallel crease lines also mean that the folding is not concentrated along one folding line but is divided over the main crease line as well as the auxiliary crease lines. The auxiliary crease lines are substantially parallel with the main crease line, but different embodiments may also exist wherein the auxiliary crease lines may also be curved or angular. In cases where the two crease lines 7 and 8 respectively do not cross each other at right angles, further shapes may occur and the chief principle therefore is only that the auxiliary crease lines should be formed and placed in such a manner that tensile stresses arising in the material are reduced and distributed to an optimum extent.

Since the stresses in the material and the risk of crack formation are greatest along the crease line along which the second or final folding takes place (crease line 8 in FIGS. 3 and 4), it is advisable that in the case of two crease lines crossing one another the auxiliary crease line should be arranged along the latter of the two crease lines used in the conversion of the laminate to the packing container. In general it is not appropriate to arrange auxiliary crease lines along crease line 7 as well as crease line 8, since the material would then be weakened excessively so that the risk of crack formation would be increased again and moreover the fold becomes inaccurate because of the unsatisfactory guiding.

The packing material should appropriately not be provided simultaneously with main crease lines and auxiliary crease lines, but the auxiliary crease lines should only be formed after the forming of the other crease lines. This separation in time is particularly desirable in the embodiment of the invention which is shown in FIG. 3, since the stretching of the material is the making of three parallel crease lines will be appreciable, especially if the crease lines are produced at the same time and are of the prevalent type, that is to say, ridge-like raisings of the material. If instead the crease lines 9 are produced at a later operating stage it is possible to utilize in the formation of the crease lines 9 partly the material accummulated in the crease line 8 situated between them, so that the danger of excessive weakening of the laminate is eliminated.

Figure 4:
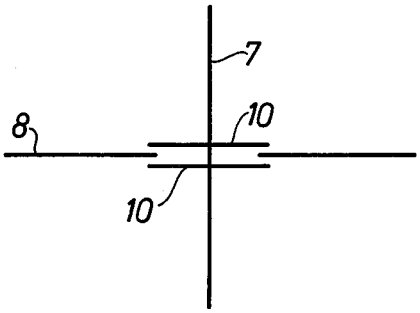
FIG. 4 shows schematically a second embodiment of a crease line pattern in accordance with the invention.

The crease line pattern shown in FIG. 4 differs from the pattern shown in FIG. 3 only in that the main crease line 8 has been discontinued on a stretch which corresponds substantially to the length of the auxiliary crease lines 10. In this manner two parallel crease lines at the most occur side by side which appreciably reduces the risk of crack formation in the crease, and in this crease line pattern it is normally possible therefore for the main crease lines and the auxiliary crease lines to be pressed in at the same time which naturally can be an advantage in practice.

In accordance with the invention a method and a packing laminate are provided wherein the problem existing hitherto of crossing or converging 180° folds have been effectively eliminated. This arrangement is simple, not expensive and allows savings to be made, since the material quality can be lowered and adapted to the appreciably smaller stresses which arise over the remaining part of the packing container surface.

The principles, preferred embodiments and modes of operation of the present invention have been described in the foregoing specification. The invention which is intended to be protected herein should not be construed as limited to the particular forms disclosed, since these are to be regarded as illustrative rather than restrictive. Variations and changes may be made by those skilled in the art without departing from the spirit of the present invention.

We claim:

1. A packing container wall portion, comprising:

at least two portions of a laminate joined together to form a sealing fin which is folded along a first fold line to overlie an adjacent portion of said laminate and which is also folded substantially 180° against itself along a second fold line which extends transversely to the first fold line; and at least one auxiliary fold line adjacent and substantially parallel to said second fold line, said at least one auxiliary fold line intersecting said first fold line, wherein said at least one auxiliary fold line assists in said folding of said sealing fin along said second fold line.

2. The packing container wall portion according to claim 1 including an auxiliary fold line on each side of said second fold line.

3. The packing container wall portion according to claim 1 wherein said second fold line is discontinuous along a length substantially corresponding to the length of the at least one auxiliary fold line.

4. The packing container wall portion according to claim 1 wherein the first and second fold lines intersect.

5. The packing container wall portion according to claim 1 wherein the first and second fold lines converge.

6. A packing container wall portion, comprising:

at least two portions of a laminate, including a fibrous carrier layer, an aluminum foil layer and at least one thermoplastic outer layer, said at least two portions of said laminate being joined together to form a sealing fin;

a first fold line in said laminate;

a second fold line in said laminate extending transversely from opposing sides of said first fold line; and an auxiliary fold line in said laminate disposed adjacent to and substantially parallel to said second fold line and intersecting said first fold line such that after a first substantially 180° fold has been made in said sealing fin along said first fold line, the at least one auxiliary fold line assists in making a second substantially 180° fold in said sealing fin along the second fold line.

7. The packing laminate according to claim 6 including a pair of auxiliary fold lines, one of said auxiliary fold lines being on each side of said second fold line.

8. The packing laminate according to claim 6 wherein the first and second fold lines intersect.

9. The packing laminate according to claim 6 wherein the first and second fold lines converge.

10. In a method of forming a packing container from a packing laminate wherein two portions of said laminate are joined together to form a sealing fin which is folded down against one of said portions of said laminate along a first fold line and wherein said sealing fin is subsequently folded against itself along a second fold line which extends transversely to said first fold line, the improvement comprising providing at least one auxiliary fold line in said laminate adjacent and substantially parallel to said second fold line and intersecting said first fold line, said at least one auxiliary fold line assisting in said folding of said sealing fin along said second fold line.

11. The method of claim 10 including providing an auxiliary fold line on each side of said second fold line.

12. The method of claim 10 wherein the first and second fold lines intersect.

13. The method of claim 10 wherein the first and second fold lines converge.

14. A method for manufacturing a packing container wall portion comprising:

providing a first fold line in a sheet of laminated material;

providing a second fold line in said sheet of laminated material, said second fold line extending transversely from opposing sides of said first fold line;

providing at least one auxiliary fold line adjacent and substantially parallel to said second fold line and intersecting said first fold line;

folding said material against itself substantially 180° along said first fold line to provide a once folded portion of said material; and subsequently folding said once folded portion substantially 180° along said second fold line with the assistance of said at least one auxiliary fold line to provide a twice folded portion.

15. The method according to claim 14 wherein said second fold line which is provided is discontinuous along a length substantially corresponding to the length of the at least one auxiliary fold line.

16. The method according to claim 14 including providing an auxiliary fold line on each side of said second fold line.

* * * * *